US007163502B2

(12) United States Patent
Fulkerson et al.

(10) Patent No.: US 7,163,502 B2
(45) Date of Patent: Jan. 16, 2007

(54) CARTON ERECTING APPARATUS

(75) Inventors: Gregory M. Fulkerson, Maple Plain, MN (US); Richard A. Erickson, Mounds View, MN (US)

(73) Assignee: Thiele Technologies, Inc., Minneapolis, MN (US)

( * ) Notice: Subject to any disclaimer, the term of this patent is extended or adjusted under 35 U.S.C. 154(b) by 75 days.

(21) Appl. No.: 11/057,467

(22) Filed: Feb. 14, 2005

(65) Prior Publication Data

US 2006/0183616 A1 Aug. 17, 2006

(51) Int. Cl.
*B31B 1/04* (2006.01)
*B31B 1/32* (2006.01)

(52) U.S. Cl. ..... 493/51; 493/64; 493/123; 493/122

(58) Field of Classification Search ..... 493/55, 493/64, 155, 181, 315, 316, 122–126; 53/565, 53/566; 198/471.1, 418.3; 414/411, 786, 414/797.7, 797.8, 798.9
See application file for complete search history.

(56) References Cited

U.S. PATENT DOCUMENTS 2,915,308 A 12/1959 Matzen
3,302,946 A 2/1967 Anderson
3,580,144 A * 5/1971 Renard ..... 493/181
3,906,705 A 9/1975 Beck et al.
4,516,765 A 5/1985 Stocco et al.
4,530,686 A 7/1985 Everson et al.
4,596,545 A * 6/1986 Greenwell ..... 493/315
4,822,234 A * 4/1989 Johnson et al. ..... 414/798.9
4,901,843 A * 2/1990 Lashyro ..... 198/418.3
4,983,154 A * 1/1991 Nagahashi et al. ..... 493/315
5,061,231 A 10/1991 Dietrich et al.
5,104,369 A * 4/1992 Calvert ..... 493/315
5,105,931 A * 4/1992 Lashyro ..... 198/471.1
5,215,515 A * 6/1993 Bershadsky ..... 493/315
5,249,916 A * 10/1993 Portrait et al. ..... 414/798.9
5,603,599 A * 2/1997 Wesslen et al. ..... 414/411
5,928,123 A * 7/1999 Davis, Jr. ..... 493/316
6,383,123 B1 * 5/2002 Ehring et al. ..... 493/315

* cited by examiner

*Primary Examiner*—Hermant M. Desai
(74) *Attorney, Agent, or Firm*—Clayton R. Johnson

(57) ABSTRACT

Rotary transfer mechanism is mounted on a frame for removing a flat folded carton from a storage hopper to move the carton to a flight conveyor assembly and in cooperation therewith erect the carton to be in an open rectangular condition. The transfer mechanism includes end plates rotated in one angular direction and vacuum cup assemblies rotated therewith and relative thereto in the opposite angular direction. The cup assemblies include transversely opposite cups having adjacent sides less flexible than their remote sides and intermediate cups having buttons therein to form dimples in a carton panel when grippingly engaged. The flight assembly includes guideways to have lugs of flight devices extend into their channels as devices move along the upper run of an endless conveyor. The flight devices include flight bars extending vertically above the lugs as the lugs move in said channels.

18 Claims, 8 Drawing Sheets

CARTON ERECTING APPARATUS

BACKGROUND OF THE INVENTION

This invention relates to apparatus for removing flat folded cartons from a hopper and erecting (opening) them.

U.S. Pat. No. 3,302,946 to Anderson disclose a rotary coupon placer that includes a spider mounted for rotation and angularly spaced shafts mounted by the spider for rotation relative thereto and rotation therewith. Each of the shafts mounts a vacuum cup. As the spider rotates the shafts are rotated relative to the spider whereby coupons are removed from a hopper to be applied to a package. As shown in the drawings, the spider is rotated in a clockwise direction and the shafts are rotated in a counterclockwise direction.

U.S. Pat. No. 4,530,686 to Everson et al discloses rotary transfer mechanism, a rotary plate, a fixed gear and planetary gears wherein as the plate is rotated, through the planetary gears, shafts 22 are rotated relative to the plate in opposite angular directions relative to the direction of rotation of the plate. The shafts 22 are located at apexes of the plate and mount vacuum cups for removing cartons from a carton storage hopper and moving them to flights on carton conveyor mechanism to open and erect the cartons.

Problems have been encountered in erecting flat folded carton blanks, especially ones that are of substantially greater lengths than their height and width when in their erected condition. In order to overcome problems encountered with prior art machines this invention has been made.

SUMMARY OF THE INVENTION

The carton erecting apparatus includes a supply hopper for retaining flat folded cartons with the forwardmost carton abutting against top and bottom retainers and flap retainers to retain the cartons in the supply hopper while retarding the movement of the forwardmost carton such that as a vacuum assembly removes the carton from the hopper, the flat folded carton assumes a generally cross sectional parallelogram shape prior to the carton being erected to be rectangular in longitudinal cross section. Also, flap retainers abut against flaps joined to a carton panel other than the one engaged by the vacuum assembly while the vacuum assembly in grippingly engage the flaps result in the gripped flaps being curved relative to the panel to which they are joined. The rotary transfer mechanism includes a plurality of angular spaced vacuum assemblies that are mounted for rotation in opposite angular directions relative to the angular direction the mechanism which mounts the assemblies is rotated. The transfer mechanism removes the cartons from the hopper to engage flight devices to at least a substantially fully open the flat folded carton while hold down bars retain the carton in a squared open condition as the flight conveyor assembly moves the open carton forwardly. The flight devices are mounted to endless chain conveyors.

One of the objects of this invention is to provide new and novel vacuum assemblies for removing a flat folded carton from a hopper in a manner facilitating the opening of the carton to an erect condition. Another object of this invention is to provide new and novel flight devices and the mounting thereof for receiving a carton from rotary transfer mechanism and more positively retaining the carton in an opened squared position as the open carton is longitudinally forwardly moved away from the position the vacuum assembly releases its gripping engagement therewith.

DETAILED DESCRIPTION OF THE INVENTION

Figure 1:
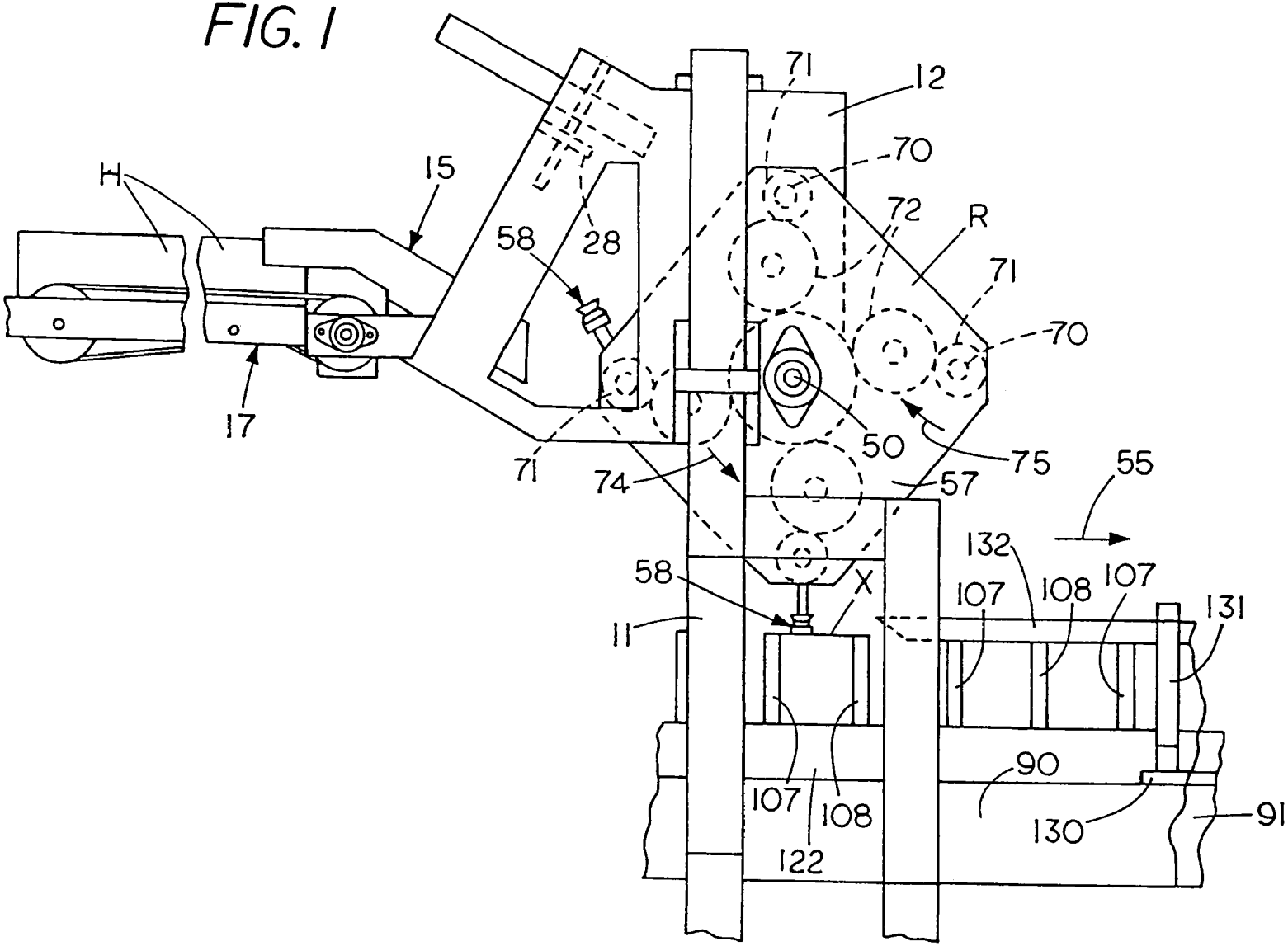
FIG. 1 is a fragmentary side view of the carton erecting apparatus of this invention, said view being generally taken along the line and in the direction of the arrows 1—1 of FIG. 3.
Figure 2:
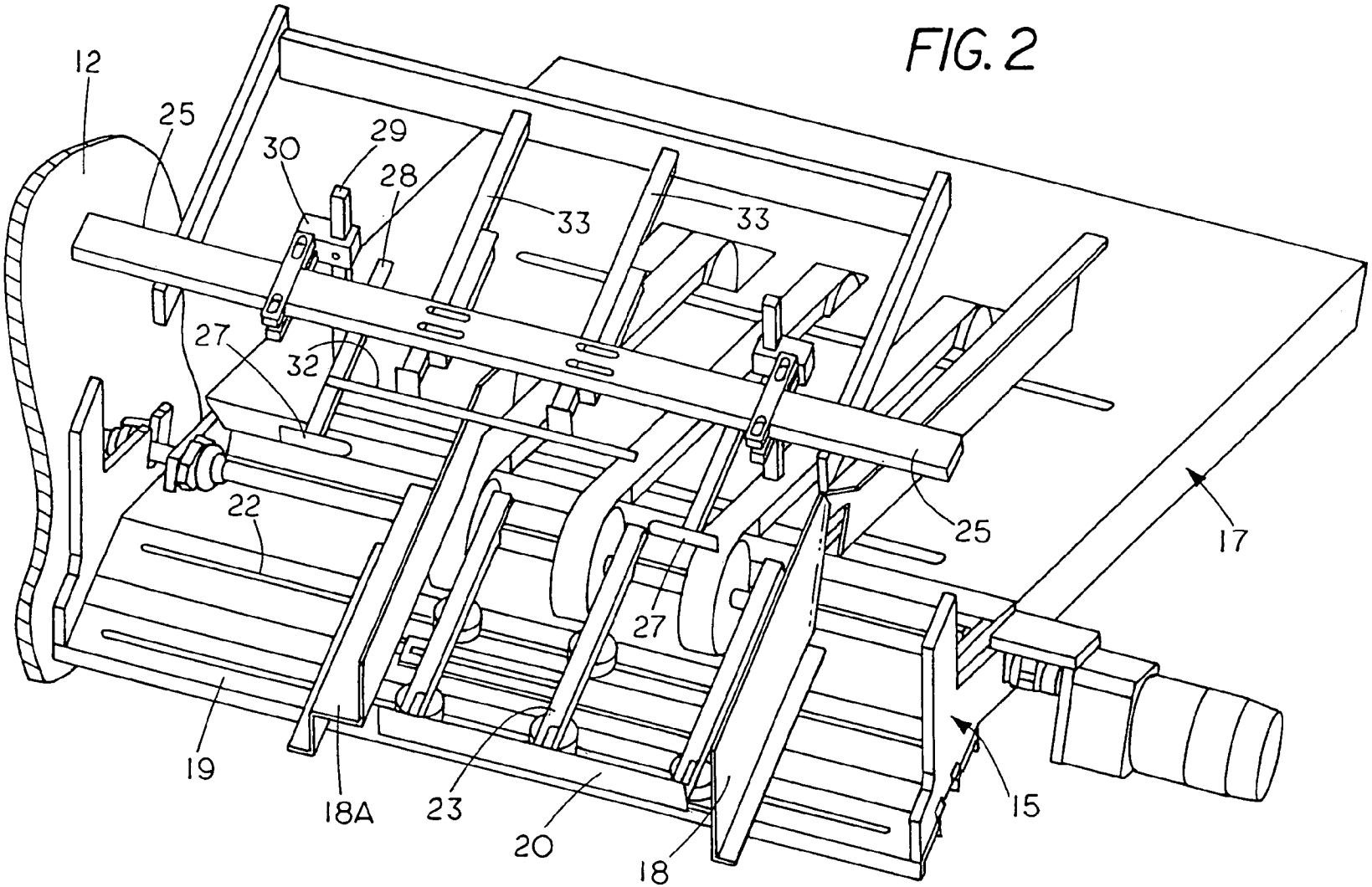
FIG. 2 is a perspective view of the storage hopper of the apparatus of FIG. 1.

Referring to the drawings, the case erecting apparatus of this invention includes a frame F having longitudinally elongated frame members 11 and mounting plates 12 that are mounted to the frame members 11. The mounting plates 12 mount a storage hopper H. The hopper includes a front chute, generally designated 15 mounted to the mounting plates and is inclined downwardly and forwardly, and endless hopper conveyer mechanism, generally designated 17 extending rearwardly of the chute. The chute includes side walls 18, 18A transversely adjustably secured to a chute plate 19 by suitable mechanism, for example, clamp bolts (not shown) extended through the slots 22 in the chute plate, and forwardly and downwardly inclined slide bars 23 that are mounted to the chute plate to receive flat folded cartons X from the conveyor 17. The front ends of the slide bars mount a transverse bottom retainer 20 to limit the forward movement of the forwardmost folded carton on the chute. The bottom retainer conditions the cartons to assure they are flat prior to removal from the hopper. The chute 15 is always full of cartons which assures there is enough weight and pressure to flatten cartons against the bottom retainer. This, in conjunction the structure of the vacuum cups 79, 80 and the mounting thereof, prevents the carton from going into an "L" shape as the carton is moved from the chute 15 to the flight conveyor assembly W.

Mounted to the mounting plates 12 at an elevation above the chute is a transverse mounting bar 25. Transversely spaced flap retainers 27 are mounted to the forward ends of bars 28 which in turn are mounted to vertical bars 29. The bars 29 are mounted to the mounting bar 25 by clamp devices 30 to permit transversely adjustably spacing the flap retainers. Mounted to the forward ends of brackets 33 to extend at a lower elevation than the brackets is a transversely elongated top retainer rod 32. The brackets 33 are mounted to the mounting bar 25.

Figure 4:
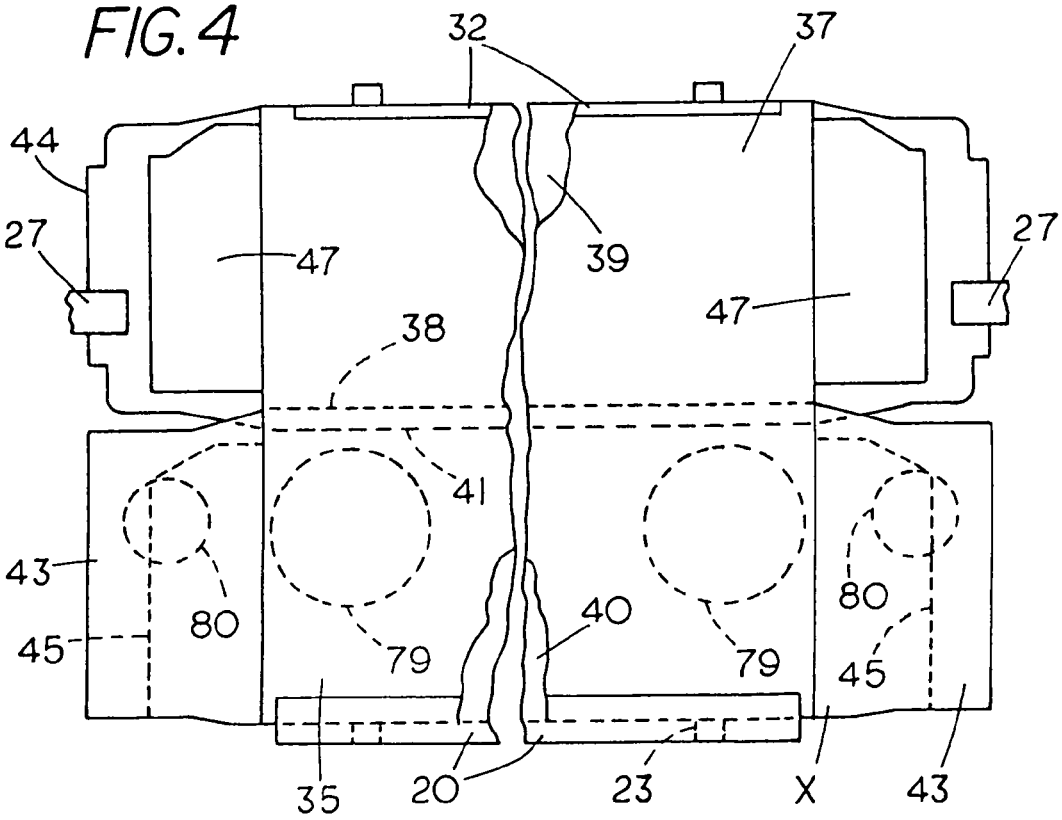
FIG. 4 is a showing of a flat folded cartoon to be erected by the apparatus of FIG. 1 together with a showing the part of the forwardmost cartoon in the storage hopper being engaged by the top, bottom and flap retains, and in dotted lines, showing the positions the vacuum cups engage the cartoon in the storage hopper, said view not showing a transverse intermediate portion of the carton and one of the vacuum cups of a vacuum assembly.

To facilitate an understanding of the invention, by referring to FIG. 4, an example of a flat folded conventional carton X in the hopper that is to be erected by this invention will be briefly described as the parts thereof appear in an erected condition. The carton when in the hopper is transversely elongated and has a top panel 35 that at its lower edge portion abuts against the bottom retainer, a rear side panel 37 joined to panel 35 along fold line 38 and having its top edge portion abutting against the top retainer rod 32, a bottom panel 39 joined to the top edge of panel 37 and a front side panel 40 joined to the bottom panel along fold line 41 and to the top panel.

Joined to the top panel to extend transversely outwardly thereof are top flaps 43 while joined to the bottom panel are bottom flaps 44. Joined to the front side panel to extend transversely outwardly thereof are side flaps 45 while joined to the rear side panel are side flaps 47. The panels 35, 37, 39, 40 are of the same transverse dimension (horizontal dimension as viewed in FIG. 4). The flaps 43, 44 extend further transversely outwardly from the respective panel to which they are joined than the panels 45, 47 extend transversely outwardly from the panels to which they are joined.

The forwardmost flat folded carton blank has at least nearly all of its flaps 44 above flaps 43 with the flap retainers 27 being in abutting relationship to flaps 44. The transversely remote edges of flaps 44 are further spaced than the transversely remote edges of flaps 47. Further, the bottom retainer 20 abuts against the lower edge portion of the top panel but is of a transverse dimension smaller than that of the top panel whereby its does not abut against the flaps 43. Additionally, the top retainer 32 abuts against the top edge portion of the rear side panel but is of a smaller transverse dimension than that of said panel and does not abut against flaps 47.

Figure 3:
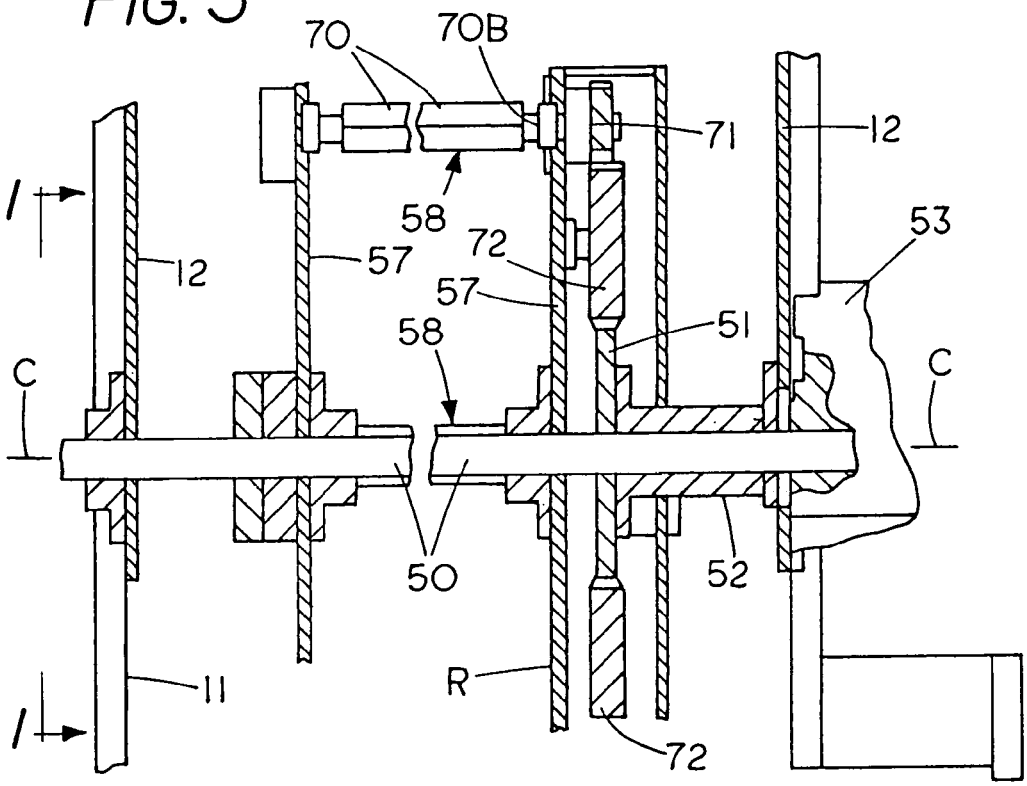
FIG. 3 is a fragmentary transverse cross sectional view of the rotary transfer mechanism of the apparatus of FIG. 1.

For removing a flat folded carton blank from the storage hopper and moving it to be deposited on the flight conveyor assembly W and in cooperation therewith erect the folded blank, rotary transfer mechanism R is mounted to the mounting plates 12 for rotation (see FIG. 3). The transfer mechanism includes a main shaft 50 mounted for rotation by and relative to the mounting plates 12 and is drivenly rotated by a motor 53 to rotate about a main shaft central axis C—C that is at a higher elevation than flight conveyor assembly W. A stationary gear 51 is mounted to one of the mounting plates 12 by a mount 52 which has the shaft rotatably extended therethrough.

Mounted to the shaft 50 to be rotated thereby are transversely space end plates 57. Mounted to the end plates for rotation therewith and relative thereto in equal radial spaced relationship to the axis of rotation of the main shaft 50 and equally angular spaced from one another are transverse vacuum assemblies, generally designated 58, for example four, although there may be more or less. Each vacuum assembly includes an assembly shaft 70 that along the major part 70B of its transverse dimension may be rectangular while its opposite end portions 70B are cylindrical.

Keyed to one end portion 70B of each assembly shaft 70 is gear 71 which in turn is in driven relationship to a gear 72, gear 72 being rotatably mounted to the adjacent end plate. Each gear 72 is intermeshing relationship to the stationary gear 50 to, as the end plates are drivenly rotated, rotate each gear 72 to rotate relative to the end plate to which it is mounted and in turn, drivenly rotates the gears 71 relative to the end plate to which they are mounted. Thus, as the shaft 50 is rotated in the direction of arrow 74, the vacuum assemblies are rotated relative to the end plates in the opposite angular direction 75. As an example, the main shaft 50 in rotating 120 degrees, each vacuum assembly shaft is rotated 360 degrees relative to the end plates.

Figure 5:
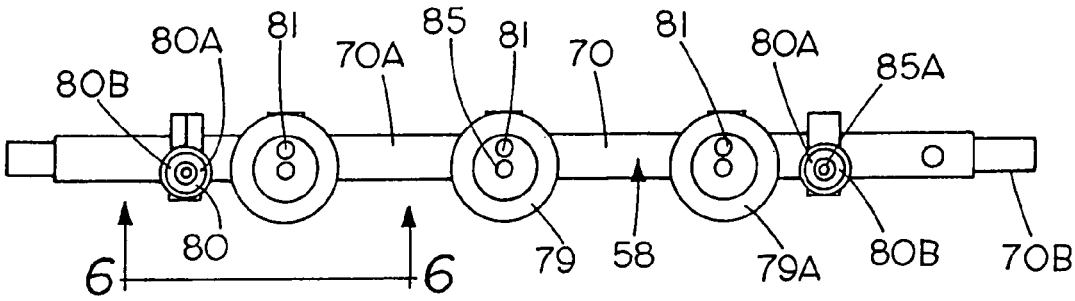
FIG. 5 is a view of one of the vacuum assemblies that is generally taken along the line and in the direction of the arrows 5—5 of FIG. 6.
Figure 6:
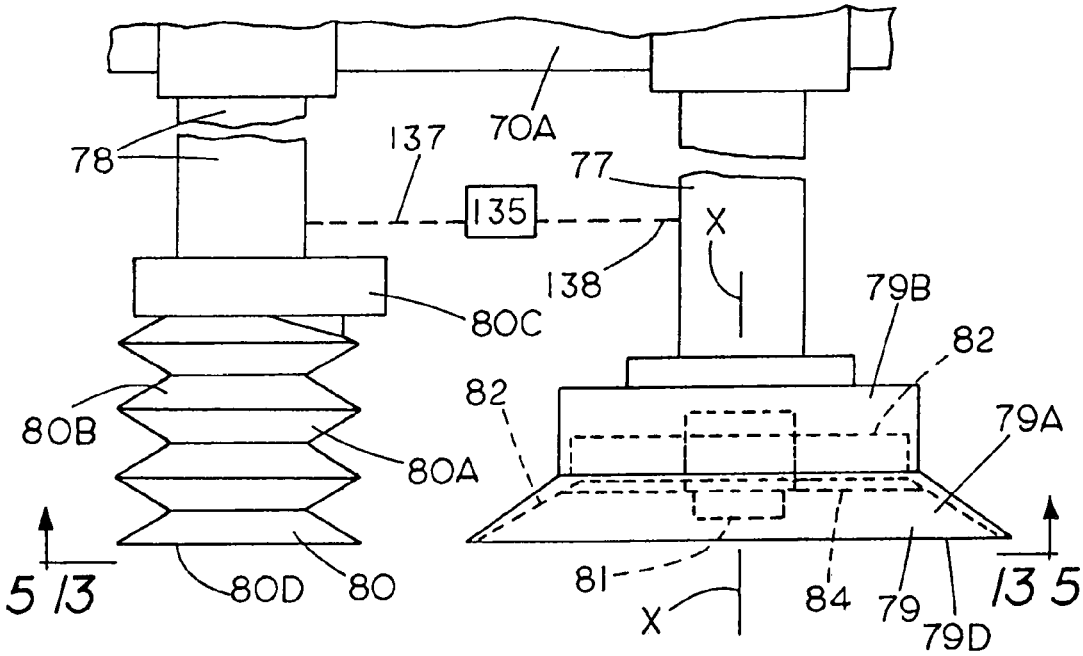
FIG. 6 is an enlarged fragmentary view of one transverse end portion of a vacuum cup assembly that is generally taken along the line and in the direction of the arrows 6—6 of FIG. 5 to show the vacuum cups as they would be prior to engagement with a carton flap and panel and prior to the application of vacuum, said view showing intermediate portion of the cup stems broken away.
Figure 7:
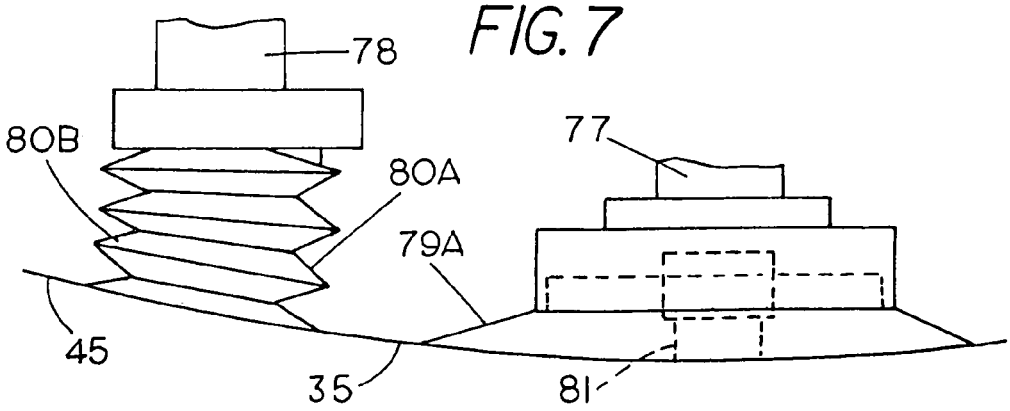
FIG. 7 is a view similar to that shown in FIG. 6 other than a vacuum has been applied to the cups with the cups being in engagement with a carton.
Figure 8:
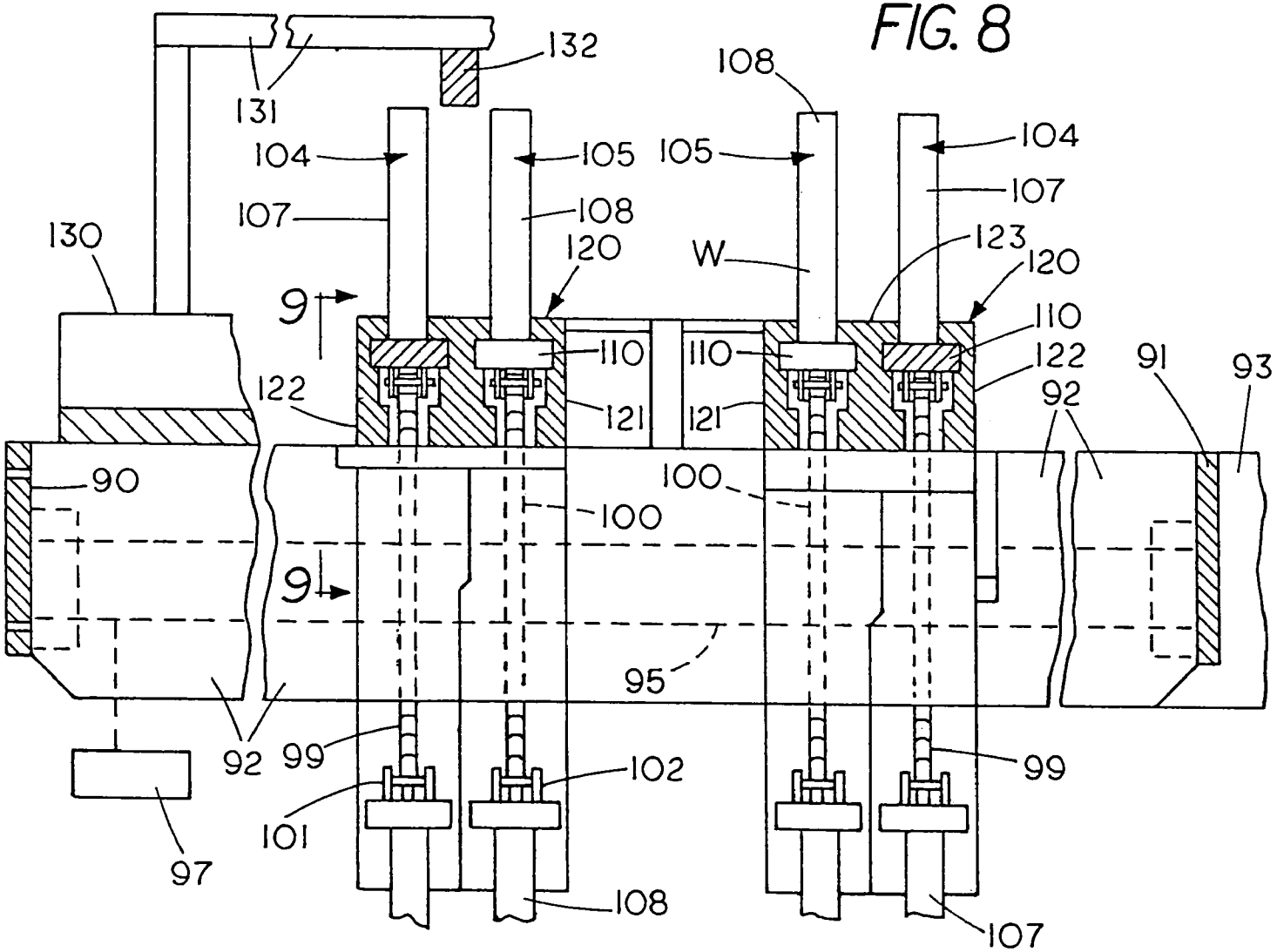
FIG. 8 is a fragmentary transverse cross sectional view of the mounting of the flight devices with transverse intermediate portions broken away.
Figure 9:
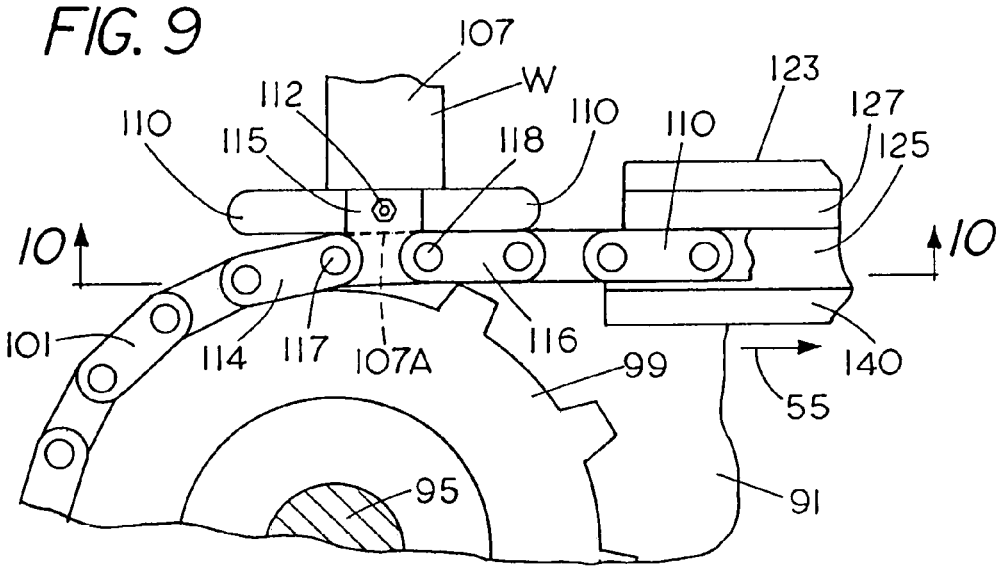
FIG. 9 is a fragmentary, enlarged side view showing the mounting of a flight device to an endless chain, said view being generally taken along the line and in the direction of the arrows 9—9 of FIG. 8 other than the adjacent guideway is not shown.
Figure 10:
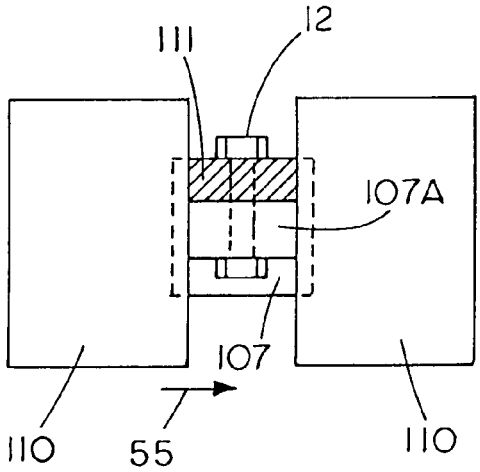
FIG. 10 is an end view of a flight device that is generally taken along the line and in the direction of the arrows 10—10 of FIG. 9 other than the guideways are not shown.

Each vacuum cup assembly includes a plurality of cup stems 77, 78 clamped to the rectangular portion of the assembly shaft (see FIGS. 5–7). For example, there are three cup stems 77 mounted in transversely spaced relationship to the intermediate portion of the assembly shaft 70 transversely intermediate the end cup stems 78 which are mounted to the transversely opposite end portions of the shaft. Stems 77 mount vacuum cups 79 while stems 78 mount cups 80. A vacuum may be applied to cups 80 and the application discontinued at desired times through lines and conventional controls 137 that fluidly connect the valve stems 78 to a vacuum source 135 while at the same time a vacuum may be applied to cups 79 and the application discontinued at the desired times through lines and conventional controls 138 to a vacuum source 135, the controls not forming a part of this invention.

When a vacuum is applied to the stems, the frustoconical rims 79A of cups 79 tend to collapse evenly around their periphery. Each cup 79 includes a rim mount 79B that mounts its frustoconical rim 79A and in combination therewith provides a vacuum chamber 82. A button 81 is mounted to the rim mount to extend within the vacuum chamber and in a cup relaxed position extends intermediate the minimum diameter part of the rim and the maximum diameter part (terminal peripheral edge 79D) of the rim. Also, the button extends further inwardly into the vacuum chamber than the cup lands 84 that facilitate applying a vacuum from the vacuum cup inlet 85 to the rim outer radial portion in a cup collapsed condition. The button is off center from the central axis X—X of the vacuum cup rim. Thus, along the central axis X—X of the cup in the cup relaxed position, the maximum distance the button extends axially away from the cup stem is intermediate the distance the minimum diameter and maximum diameter edges of the rim extend away from the stem and the shaft 70. When a vacuum is applied to the cup with its peripheral edge 79D is in engagement with the carton panel, the cup is at least partially collapsed. The cup in at least partially collapsed condition, for example as shown in FIG. 7, the rim peripheral edge 79D, in a direction parallel to the central axis X—X, moves more closely adjacent to the rim mount than with the cup in its relaxed position of FIG. 6 and desirably moves more closely adjacent to the rim mount than the surface of the button that is most remote from the rim mount.

The buttons 81 are equally radially spaced from the cup inlets and are transversely aligned in the direction of elongation of the assembly shaft. Further, the maximum diameters of the buttons may be less than about half of the inner diameter of the vacuum chamber at the intersection of the rim to the rim mount. That is, advantageously, in a plane perpendicular to the central axis X—X, the maximum diameter of the button is less than half of the minimum diameter of the frustoconical rim. Without the buttons the rims 79A could further collapse, even flatten out, whereby the holding power is decreased when a vacuum is applied and the cup grippingly engages a carton The vacuum cups 80 are of an accordion type and desirably each in a relaxed position (no vacuum applied) has its terminal peripheral edge 80D, which is most remote from the assembly shaft, in the same plane as the peripheral edge 79D of each of the cups 79 that is most remote from the assembly shaft 70. The diameters of the peripheral edges 80D are less than the diameters of the edges 79D, for example about half. Advantageously, the vacuum cup inlets 85A open to the vacuum chambers of the cups 80 from the vacuum cup stems 78 in substantial transverse alignment with one another and in centered relationship to the cup rim portions.

The transversely opposite halves 80B of the two vacuum cups 80 are of a greater flexibility than the transversely adjacent halves 80A. For example, the halves 80B may be of a progressively thinner material in a direction transversely away from the cup halves 80A. Thus, when a vacuum is applied to the cups 80 with their rims in engagement with the respective carton end flap 43, the more transversely remote portions of the rims 80D move more closely adjacent to the respective shaft 70 than the rim portions more closely adjacent to cup halves 80A whereby the flaps are accordingly curved to have the transversely remote parts of the gripped flaps more closely adjacent the shaft 70 than the transversely adjacent parts.

The flight conveyor assembly W is in part mounted by longitudinally elongated frame member 90, 91 which are in part mounted by frame members 11 to extend forwardly and rearwardly thereof (see FIGS. 1, 8–10}. Further, the frame includes transverse frame members 92, 93 that are mounted to frame member 90, 91 and mount longitudinally space front and rear transverse shafts 95, (the front shaft not being shown). One of the transverse shafts is driven by a motor 97. Mounted on each of the transverse shafts is a pair of transverse outer sprockets 99 and therebetween transverse inner sprockets 100. Sprockets 99 mount endless conveyor chains 101 while sprockets 100 mount endless conveyor chains 102. Advantageously, the upper runs of the conveyor chains are at a lower elevation than the main shaft central axis C—C which in turn may be at a lower elevation than the lowermost part of the forwardmost flat folded carton in the storage hopper Each of the endless conveyor chains 101 mount a plurality of spaced flight devices, generally designated 104, along the length thereof, while each of the chains 102 mount a plurality of flight devices, generally designate 105, along the length thereof. Each of the flight device 104, 105 includes elongated flight bars respectively designated 107, 108. Joined to the base of each of the flight bars are a pair of slide lugs 110, the lugs of each flight device being spaced in the direction of the elongated of, for example, the upper run of the respective chain. The lugs are of greater transverse dimension than that of the conveyor chains and of the flight bars to which they are joined. Further, the lugs extend both forwardly and rearwardly of the flight bar to which they are joined.

Each flight bar in a vertical condition extending above the upper run of the respective chain 101, 102 includes a tab 107A extending downwardly between the lugs and joined thereto and is narrower than the transverse dimensions of the lugs. Each chain includes a mounting link 115 that along its upper run is connected to the adjacent rearward links 114 by pivot pins 117 and forwardly thereof, connected to the adjacent links 116 by pivot pins 118 while thereabove the mounting link 115 is pivotally connected to the tab 107A by a pivot fastener 112.

In order to maintain the flight devices in vertical upright positions without rocking movement as the flight devices are moved along the conveyor chains upper runs there are transversely spaced, longitudinally elongated parallel guideways, generally designated 120, that are mounted to the frame members 92, 93 to extend from a position beneath the rotary mechanism R and rearwardly thereof to a forward position for further operations relative to the erected cartons. The guideways have top surfaces that are substantially coplanar to have an erected carton slide forwardly thereover. Each guideway includes longitudinally elongated, transversely spaced outer parts (members) 121, 122 and a transverse intermediate part (member). The rear most part of the guideways extend from a position vertically above the forwardmost portion of the rear sprockets where the lugs extend generally horizontally both forwardly and rearwardly of the flight bar to which they are joined and the flight bar extends upwardly.

Figure 11:
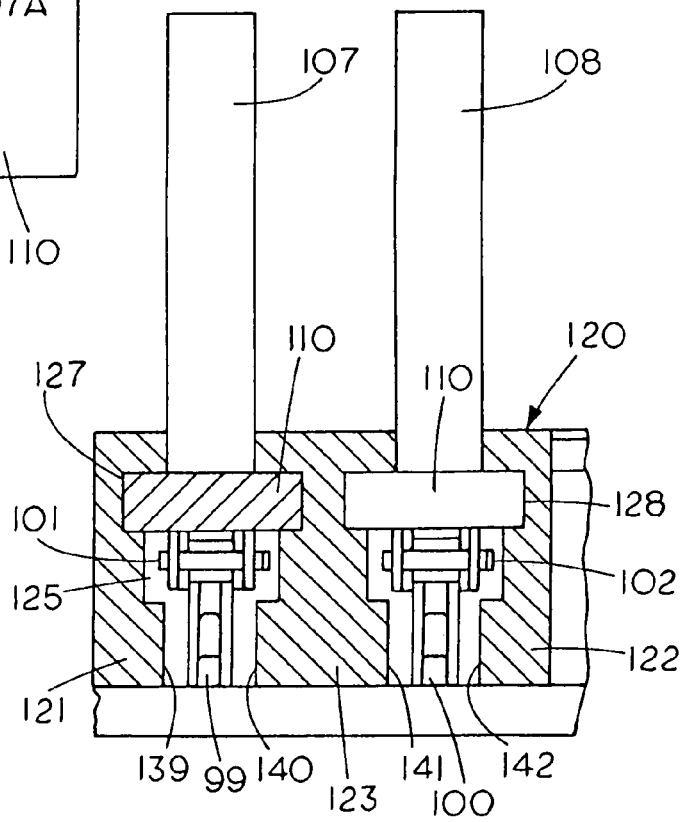
FIG. 11 is an enlarged fragmentary transverse cross sectional view showing the flight devices lugs extending into guide ways.
Figure 12:
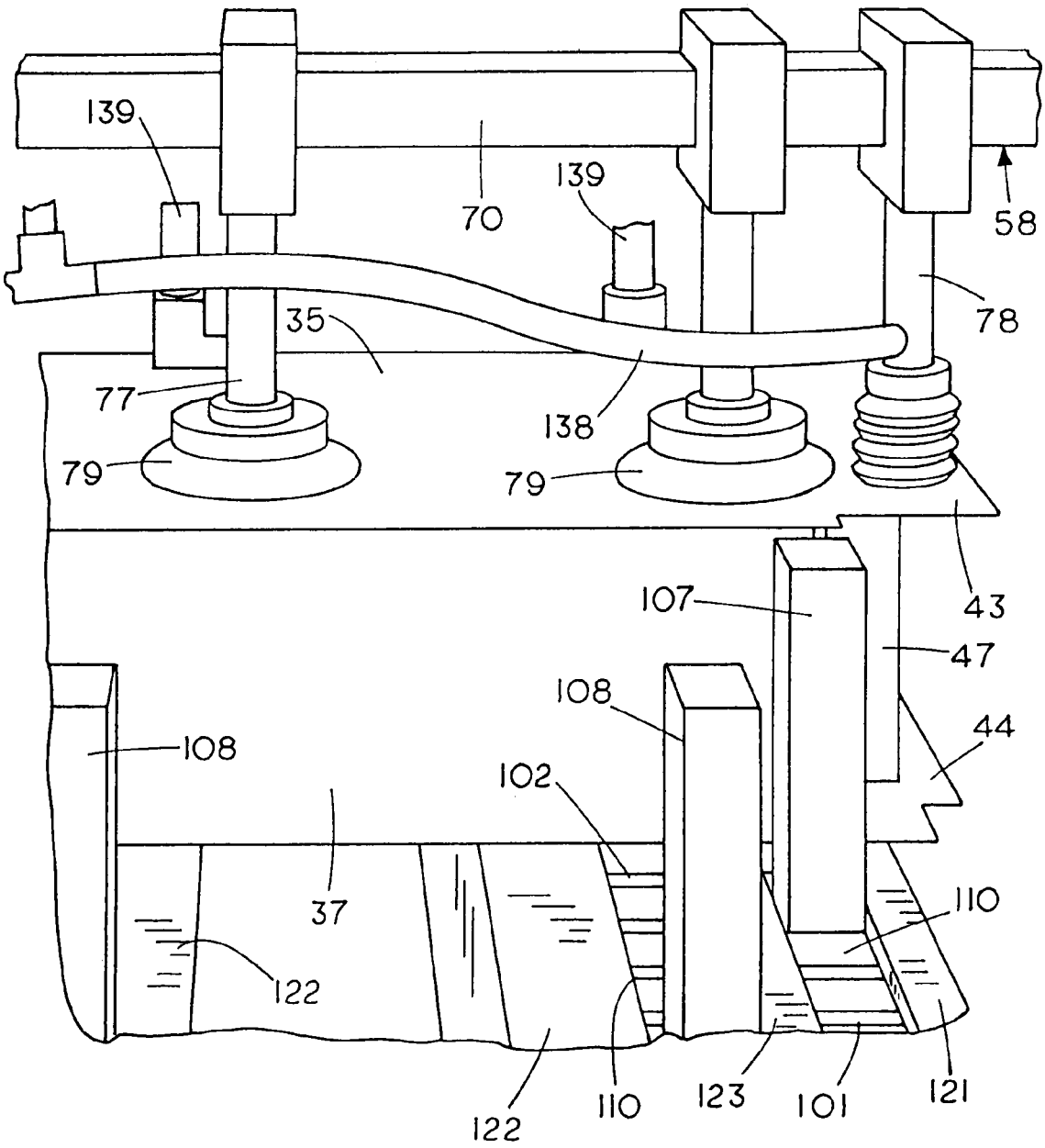
FIG. 12 is a fragmentary perspective view of a carton in an open erected condition just as the vacuum is to be released from the vacuum cups and adjacent mechanism.
Figure 13:
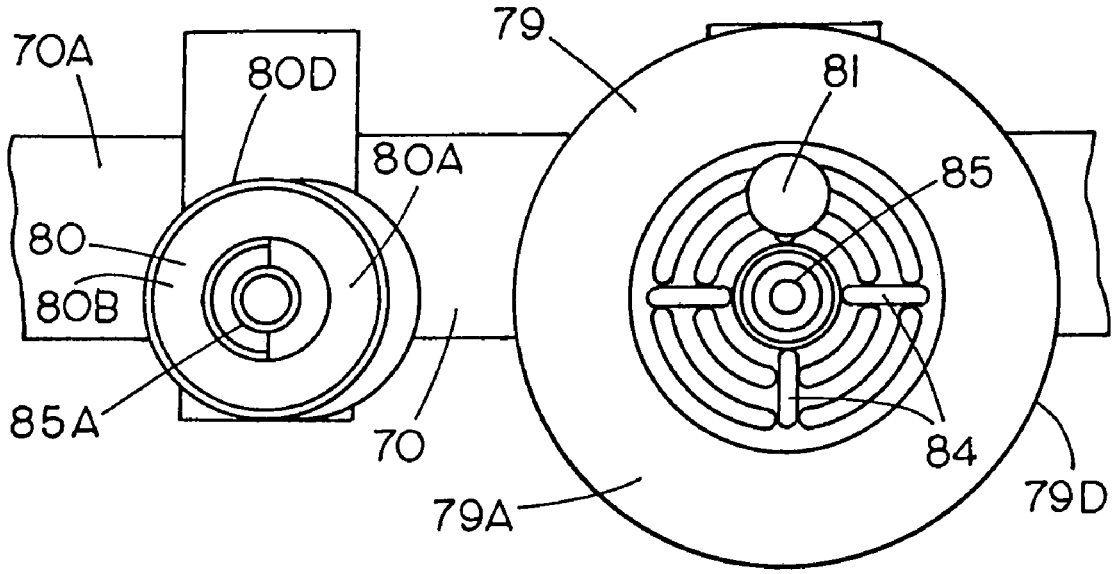
FIG. 13 is a view looking along the line and in the direction of the arrows 13—13 of FIG. 6.

Referring to FIG. 11, the lower portions 139, 140 of the guideway parts 121, 123 are transversely spaced greater than the upper part of the adjacent sprocket while the vertically intermediate portions of these guideway parts are further spaced to provide channels 125 opening toward one another to permit the upper runs of the chains 101 to move therethrough without engaging the guideways, but are of smaller transverse dimensions than the corresponding dimensions of the lugs 110. Above the channels 125, the guideway parts 121, 123 have channels 127 opening toward one another with the lugs of the flight bars 107 forming close sliding fit therewith as the chains move the flight bars longitudinally forwardly. Similarly each of the guideways 122, 123 have lower portions spaced greater than the top portions of sprockets as the sprockets rotate, vertically intermediate portions to have the upper runs of chains 102 to move therethrough and upper channels 128 opening toward one another with the lugs of flight bars 108 forming a close sliding fit therewith. As a result of providing the top channels 127, 128 in the guideways and the lugs moving therethrough, there is no sagging of the chain upper runs as the lugs move therethrough the top channels.

Brackets 131 mount transversely spaced, longitudinally elongated hold down bars 132 (only one being shown) to mounting members 130 which in turn are mounted to the transverse frame member 92, 93 to extend above the guideways for, in conjunction with the guideways and the flight bars, retain the erected carton blanks in an erected condition, generally rectangular in a longitudinal direction, as the erected blank is moved longitudinally forwardly (direction of arrow 55) of the rotary transfer (placement) mechanism. With reference thereto, the guideways have the bottom panels of the erected cartons sliding therealong as the erected cartons are moved forwarded by the flight bars 107. Advantageously, the rear end portions of the end bars are sloped forwardly and downwardly to force the front part of the open carton blank downwardly as it is moved forwardly and the vacuum cups move out of engagement therewith in the event the bottom panel slopes upwardly and forwardly relative to the guideways.

In using the apparatus of this invention, the storage hopper is loaded with flat folded blanks to have the forwardmost blank abutting against the retainers as previously mentioned. The top and bottom retainers advantageously extend along at least three fourths of mid-portion of transverse dimension of the flat folded cartons together with the weigh to cartons on the inclined chute bars 23 pressing against the forwardmost carton in the storage hopper prevents bowing of the carton as the carton blank is withdrawn from the hopper but does not prevent the gripped panel having dimples formed therein and the gripped flaps being curved such as described herein. A vibrator (not shown) may be provided to facilitate the carton blanks sliding down the inclined chute bars to aid in preventing bowing of the forwardmost carton as it is being removed from the hopper. As the flat folded carton moves pass the top retainer rod by a vacuum cup assembly, the carton opens to a parallelogram shape. As the forwardmost blank is removed from the hopper, the blanks on the inclined chute bars move forwardly and if the amount of blanks on the chute portion sufficiently decreases, the hopper endless conveyor is actuated in a conventional manner to move the blanks thereon forwardly. As the rotary transfer (placement) mechanism rotates, one of the vacuum cup assemblies has it vacuum cup stems extends generally radially away from the shaft 50 and at least nearly perpendicular to the forwardmost blank, the vacuum cups thereof with a vacuum applied thereto engage the flaps 43 and panel 35 of the forwardmost blank on the hopper at locations such as indicated by dotted lines in FIG. 4.

Since the transversely remote sides 80B of the cups 80 are of thinner plastic material and collapse more than the transverse opposite sides 80A of these cups when in engagement with the flaps and a vacuum applied thereto, the flaps 43 are curved relative to the top panel 35 to extend further forwarded of the generally plane of panel 35 in directions transversely away from panel 35. Additionally, flaps 43 as they extend further transversely away from panel, they are curved to be further spaced from flaps 45 in a direction away from the juncture of the top panel to panel 40. Further, as the cups 79 engage the panel 35 and vacuum applied thereto, the radial outer periphery of rim portions 79A move more closely toward the valve stems than end surfaces of the buttons that are most remote from the stems 77. Accordingly, the portions of the panel 35 gripped by cups 79 are concavely curved (dimpled) to open toward the cup stems 77, the panel 35 being wavy across it transverse dimension. This results in the transverse dimension of the top panel between the flaps 43 becoming somewhat smaller than it was in the flat folded condition before being gripped. This facilitates the opening of the carton to an erected condition and the moving of the fold line 41 away from fold line 38.

The provision of the buttons and the fact that as the cups rotate about their shaft axes in the direction of arrows 75 relative to the end plates 57 and the end plates rotate in the direction of arrow 74, the gripped blank is moved upwardly (lifted upwardly) relative to the bottom retainer 20 to clear the bottom retainer while the movement of the upper edge portion of panel 37 is retarded by the top retainer rod 32 and retains the panel 37 in a generally planar condition. This results in panel 37 being bent out of the plane of panel 35 that it was in before the initiation of the removal movement of the flat folded carton from the storage hopper.

The end plates are rotated about 120 degrees from the position that vacuum cups grippingly engage a flat folded blank in the hopper to a position the vacuum to the cups is released (discontinued) to deposit an erected blank on the guideways to be moved forwardly by the flight bars 107. During this period of time each vacuum cup assembly is rotated about 270 degrees or somewhat less relative to the end plates.

Figure 14:
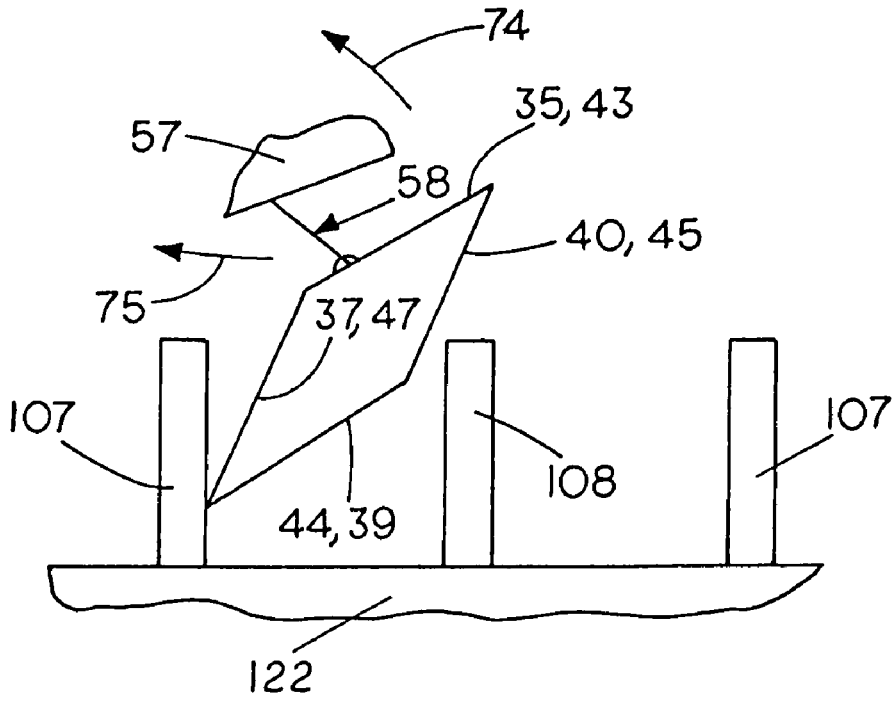
FIG. 14 is a somewhat diagrammatic view of the gripped carton as it is being engaged by flight bars.

As the end plates are rotated to move the vacuum cup assembly with the carton gripped thereby to a position the vacuum cup stems approach extending vertically downwardly of the shaft 50, the juncture of panel 37 to panel 39 engages the front surfaces of the flights bars 107 such as indicated in FIG. 14. The rotation of the vacuum cups gripping the blank and the flight bars 107 in moving forwardly in engagement with the blank cooperate to more fully open the blank. The continued rotation of the vacuum assembly in the direction of arrow 55, the end plates 57 in the direction of arrow 74 move the gripped carton further downwardly toward the guideways while the forward movement of the flight bars that are in engagement with the carton result in the carton being moved to its fully open (erect) condition and if not, the movement of the carton in engaging the hold down bars finishes the carton blank assuming an open squared erected condition.

At the time the vacuum to the cups is released, the carton is substantially fully open (rectangular shape) with longitudinal spacing of the flight bars 107 and the forwardly adjacent flight bars 108 being only slightly greater, if not substantially the same as the longitudinally dimensions of the top and bottom panels 35, 39 of the erected carton. As the vacuum cups move out of engagement with the erected carton, the erected carton is moved beneath the hold down bars 132 whereby the erected carton retains its open rectangular condition. Due to the lugs moving in the guideways, the carton retains its rectangular shape as it moves forwardly and the edges of the end flaps 43, 44 are more closely aligned when moved to their closed position by conventional structure that does not form part of this invention. Thus, for example, if there is printing with part of indicia on flap 43 and part on the transversely adjacent flap 44, upon moving these flaps to a closed position, the indicia extending across these flaps will be aligned.

What is claimed is:

1. Carton erecting apparatus for erecting transversely elongated flat folded cartons having top, bottom and first and second side panels and end flaps, including first and second top flaps, extending transversely outwardly of each of the respective panels, comprising a longitudinally elongated frame, a storage hopper for storing a supply of flat folded cartons with one in front of another, a flight conveyor assembly mounted to the frame for receiving a carton that has been removed from the storage hopper and moving an erected carton in a forward direction, and rotary transfer mechanism mounted to the frame for removing the forwardmost flat folded carton from the hopper, moving the flat folded carton relative to the flight conveyor to in cooperation therewith open the flat folded carton to an erected generally rectangular open condition, and depositing the erected carton on the flight conveyor assembly for being moved in a forward direction, the rotary transfer mechanism including a driven shaft mounted to the frame and having a transverse center axis of rotation, end plates mounted to the driven shaft for rotation therewith in one angular direction, a vacuum cup assembly mounted to the plates in radial space relationship to the driven shaft for rotation therewith and relative thereto for grippingly engaging the forwardmost flat folded carton on the hopper and moving the gripped carton to in cooperation with the flight conveyor erect the flat folded carton as the vacuum cup assembly and end plates rotate and means for drivingly rotating the vacuum cup assembly in the opposite angular direction from the direction of rotation of the driven shaft, the vacuum cup assembly including a transversely elongated assembly shaft having a first end portion, a second end portion and an intermediate portion extending between the shaft first and second end portions, a first and a second vacuum cup mounted to the first and second end portions respectively for gripping the first and second top flaps respectively and at least one third vacuum cup mounted to the assembly shaft intermediate the first and second cups for grippingly engaging the top panel of the carton, each of the cups having a terminal peripheral edge, the first and second cups having transversely adjacent halves and transversely opposite halves that are of a greater flexibility than the adjacent halves, the cups, when in a relaxed position out of engagement with the carton, having their peripheral edges in substantially the same plane.

2. The carton erecting apparatus of claim 1 wherein the at least one third cup has a rim with the third cup peripheral edge, the first and second cups are of relative flexibility that when a vacuum is applied to the cups with the cups in engagement with a flat folded carton, the peripheral edges of the first and second cups are at least in part drawn to extend more closely adjacent to the assembly shaft than the at least one third cup peripheral edge.

3. The carton erecting apparatus of claim 1 wherein the at least one third vacuum cup has a rim mount for mounting its rim and a button mounted by the rim mount to extend intermediate the distance from the rim mount to its peripheral edge and within the confines of the rim.

4. The carton erecting apparatus of claim 3 wherein the rim of the at least one third cup rim is frustoconical and has a minor base and a major base more remote from its rim mount than the minor base and its button is of maximum diameter that is less than half the diameter of the minor base.

5. The carton erecting apparatus of claim 1 wherein the flight conveyor assembly includes at least a first driven endless conveyor that has a longitudinally elongated upper run, a longitudinally elongated first guideway member extending along the upper run, said guideway member having a longitudinally elongated channel and a plurality of spaced flight devices along the length of the endless conveyor and mounted to the endless conveyor to move therewith, each flight device having a flight bar that has a base mounted to the endless conveyor and at least one lug joined to each flight bar and extended into the guideway channel when being moved by the upper run, each flight bar extending vertically above the upper run when the lug jointed thereto extends within the channel.

6. The carton erecting apparatus of claim 5 wherein the flight conveyor assembly includes a second longitudinally elongated guideway member extending along the upper run and having an elongated channel opening toward the first guideway channel for having the at least one lug extended thereinto when the respective flight device to which it is joined being moved by the upper run.

7. The carton erecting apparatus of claim 6 wherein a second lug is joined to each flight bar with the one lug and the second lug respectively extending forwardly and rearwardly of the flight bar to which it is joined and the second lug extends into the channels as the respective flight bar is moved along by the upper run and the lugs forming a close sliding fit with the channels as the upper run moves the respective flight bar forwardly.

8. The carton erecting apparatus of claim 6 wherein the flight conveyor assembly includes a second and a third driven endless conveyor that each has a longitudinally elongated upper run, a second and third longitudinally elongated guideway member extending along the upper run of the second and third conveyor respectively, each of the second and third guideways members having a longitudinally elongated channel and a plurality of second and third flight devices along the length of each of the second and third endless conveyors respectively and mounted to the second and third endless conveyor respectively to move therewith, the first endless conveyor being transversely intermediate the second and third conveyor and the first flight bars being longitudinally spaced forwardly of transversely and rearwardly of the adjacent second and third flight bars at very nearly the dimension of top panel of an erected carton.

9. The carton erecting apparatus of claim 8 wherein the forwardmost carton in the storage hopper has its top panel below the first side panel and joined to the second side panel to be forwardly thereof and the bottom panel is joined to the first side panel and is rearwardly thereof, the storage hopper has a bottom retainer for abutting against the forwardmost carton adjacent its juncture of the top panel to the second side panel, a top retainer for abutting against the forwardmost carton adjacent to its juncture of the first side panel to the bottom panel, the vacuum cup assembly in grippingly engaging the forwardmost carton is moved by the rotation of the end plates and moved relative to the end plates to grippingly engage the forwardmost carton top wall to move the gripped carton upwardly and forwardly relative to the top retainer to initiate the opening of the forwardmost carton and move the gripped carton into engagement with second and third flight bars as they are being moved forwardly to complete the erecting of the gripped carton.

10. The carton erecting apparatus of claim 9 wherein the at least one third vacuum cup includes a rim having the third cup peripheral edge, a rim mount for mounting its rim and a button mounted by the rim mount to extend within the rim intermediate the distance from the rim mount to its rim peripheral edge and within the confines of the rim, the at least one third cup when grippingly engaging the flat folded carton with a vacuum applied thereto having its peripheral edge drawn more closely adjacent to the rim mount than the maximum distance the button extends away from the rim mount.

11. Carton erecting apparatus for erecting transversely elongated flat folded cartons having top, bottom and first and second side panels and end flaps, including top flaps, extending transversely outwardly of each of the panels, comprising a longitudinally elongated frame, a storage hopper for storing a supply of flat folded cartons with one in front of another, a flight conveyor assembly mounted to the frame for receiving a carton removed from the storage hopper and moving an erected carton in a forward direction, and rotary transfer mechanism mounted to the frame for removing the forwardmost flat folded carton from the hopper, moving the flat folded carton relative to the flight conveyor to in cooperation therewith open the flat folded carton to an erected generally rectangular open condition and depositing the erected carton on the flight conveyor assembly for being moved in a forward direction, the rotary transfer mechanism including a driven shaft mounted to the frame and having a transverse axis of rotation, end plates mounted to the driven shaft for rotation therewith in one angular direction, a vacuum cup assembly mounted to the plates in radial space relationship to the drive shaft for rotation therewith and relative thereto for grippingly engaging the forwardmost flat folded carton on the hopper and moving the gripped flat folded carton to in cooperation with the flight conveyor assembly erect the carton as the vacuum cup assembly and end plates rotate and means for drivingly rotating the vacuum cup assembly in the opposite angular direction from the direction of rotation of the driven shaft, the vacuum cup assembly including a transversely elongated assembly shaft, a plurality of first vacuum cups mounted to the assembly shaft for gripping the forwardmost flat folded carton in the storage hopper, each of the cups having a rim mount, a rim mounted by the rim mount to provide a vacuum chamber and having a peripheral edge for engaging the forwardmost carton in the hopper and a button mounted by the rim mount to extend within the vacuum chamber, the button extending into the vacuum chamber a shorter distance from rim mount than the peripheral edge is spaced from the rim mount when no vacuum is applied to the vacuum chamber and to extend a greater distance from the rim mount when the cup grippingly engages the carton whereby a dimple is formed in the gripped carton.

12. The carton erecting apparatus of claim 11 wherein each rim is frustoconical, the vacuum cup assembly includes a stem for each cup that mounts the respective cup to the assembly shaft and opens through the stem mount to the vacuum chamber in radial spaced relationship to the button.

13. The carton erecting apparatus of claim 12 wherein the vacuum cup assembly includes a second vacuum cup and a third vacuum cup mounted to the assembly shaft with the first cups being transversely therebetween, the second and third cups having transversely adjacent portions and transversely opposite portions that are of a greater flexibility than their transversely adjacent portions.

14. The carton apparatus of claim 13 wherein the rotary transfer mechanism includes at least a second and a third vacuum cup assembly mounted to the end plates in angular spaced relationship relative to the first vacuum cup assembly for rotation with the end plates and relative thereto, each of the second and third vacuum cup assembly including a transversely elongated assembly shaft and a plurality of transverse spaced vacuum cups mounted to the respective assembly shaft and the flight conveyor assembly includes a plurality of transversely spaced elongated conveyors that each has a longitudinally elongated upper run, each conveyor having a plurality of spaced flight devices connected thereto to move therewith, the flight devices each including an elongated flight bar having a base portion mounted to extend above the respective upper run and a lug joined to the base portion to extend transversely outwardly thereof and longitudinally elongated means mounted to the frame adjacent to the upper runs for guiding the lugs as the flight bars are moving along the upper runs, said guide means having longitudinally elongated channels for having the lugs extended thereinto with the flight bars that are joined thereto extending above the lugs and the upper runs extended therethrough.

15. In apparatus for erecting flat folded cartons having top, bottom and first and second side panels and end flaps, including top flaps, extending transversely outwardly of each of the panels, comprising a vacuum cup for having a vacuum applied thereto for grippingly engaging a panel, said cup having a central axis, a rim mount, a rim joined to the rim mount to in combination therewith provide a vacuum chamber, said rim having a peripheral edge remote from the rim mount and being movable between a relaxed condition when no vacuum is applied to the chamber and at least a partially collapsed condition and a button mounted to the rim mount to extend within the vacuum chamber a shorter distance than the spacing of the peripheral edge from the rim mount in a direction parallel to the central axis and a greater distance than the spacing of the peripheral edge in said direction when a vacuum is applied to said chamber and the rim is in at least a partially collapsed condition.

16. In the apparatus of claim 15 wherein the maximum dimension of the button in a direction in a plane perpendicular to the central axis is less than about half of the minimum diameter of the rim.

17. In the apparatus of claim 15 wherein the rim mount has an opening for applying a vacuum to the vacuum chamber and the button is offset from said opening and the central axis.

18. Carton erecting apparatus for erecting transversely elongated flat folded cartons having top, bottom and first and second side panels and end flaps joined to each panel to extend transversely outwardly thereof, including first and second top flaps, comprising a longitudinally elongated frame, a storage hopper for storing a supply of flat folded carton with one in front of another, a flight conveyor assembly mounted to the frame for receiving a carton removed from the storage hopper and moving the erected carton in a forward direction, and rotary transfer mechanism mounted to the frame for removing the forwardmost flat folded carton from the hopper and moving the flat folded carton relative to the flight conveyor assembly to in cooperation therewith open the flat folded carton to an erected generally rectangular open condition, the rotary transfer mechanism including a driven shaft mounted to the frame and having a transverse axis of rotation, end plates mounted to the driven shaft for rotation therewith in one angular direction, a vacuum cup assembly mounted to the plates in radial spaced relationship to the driven shaft for rotation therewith and relative thereto for grippingly engaging the forwardmost flat folded carton on the hopper and moving the gripped flat folded carton to in cooperation with the flight conveyor erect the carton as the vacuum cup assembly and end plates rotate and means for drivingly rotating the vacuum cup assembly in the opposite angular direction from the direction of rotation of the driven shaft, the vacuum cup assembly including a transversely elongated assembly shaft, a plurality of first vacuum cups mounted to the assembly shaft for gripping the forwardmost flat folded carton in the storage hopper, and the flight conveyor assembly includes a plurality of transversely spaced endless conveyors having longitudinally elongated upper runs, each endless conveyor includes an endless chain having a forwardly movable upper run, a plurality of longitudinally elongated guideways extending along the upper runs, the guideways including longitudinally elongated guideway portions extending on transversely opposite sides of the upper run of each of the endless chain, each of the endless chains being driven at the same rate, each conveyor having a plurality of spaced flight devices connected thereto to move therewith, the flight devices each including an elongated flight bar having a base portion mounted to extend above the respective upper run and a lug joined to the base portion to extend transversely outwardly thereof, the endless chains including at least a first and a second and a third chain with the first chain being transversely therebetween the second and third chains, the guideways having channels for having the lugs along the upper runs extending therein and forming a close fit with the lugs with the flight bars that are joined thereto extending above the lugs, the flight bars of the flight devices on the first chain being forwardly longitudinally offset from flight bars of flight devices on the second and third chain to have an erected carton extend therebetween, the vacuum cup assembly including a transversely elongated assembly shaft having a first end portion, a second end portion and an intermediate portion extending between the shaft first and second end portions, a first and second vacuum cup mounted to the first and second end portions respectively for gripping the first and second top flaps respectively and at least one third vacuum cup mounted to the assembly shaft intermediate the first and second cups for gripping the top panel, each of the cups including a rim that has a peripheral edge for grippingly engaging the forwardmost carton in the hopper, moving the grippingly engaged carton to contact the flight bars on the second and third chains as the flight bars on the upper runs are moving forwardly and in cooperation therewith open the gripped carton to have the panels thereof be in a generally rectangular configuration, the first and second cups having transversely adjacent halves and transversely opposite halves that are of a greater flexibility than the adjacent halves to when grippingly engaging flaps of the carton, bend the gripped flaps to curved more closely adjacent to the assembly shaft in a direction transversely away from the panel to which they are joined, the cups in a relaxed position out of engagement with a carton, having the peripheral edges of the rims in substantially the same plane.

* * * * *